US012616254B1

(12) United States Patent
Peng

(10) Patent No.: US 12,616,254 B1
(45) Date of Patent: May 5, 2026

(54) CONVENIENT ADJUSTABLE SHAPER BRA

(71) Applicant: Xiaoni Peng, Weinan (CN)

(72) Inventor: Xiaoni Peng, Weinan (CN)

( * ) Notice: Subject to any disclaimer, the term of this patent is extended or adjusted under 35 U.S.C. 154(b) by 0 days.

(21) Appl. No.: 19/024,478

(22) Filed: Jan. 16, 2025

(51) Int. Cl.
*A41C 3/00* (2006.01)
*A41D 1/22* (2018.01)

(52) U.S. Cl.
CPC ..... *A41C 3/0028* (2013.01); *A41C 3/0021* (2013.01); *A41D 1/22* (2013.01)

(58) Field of Classification Search
CPC ..... A41C 3/0028; A41C 3/0021; A41D 1/22
USPC ..... 450/30–33
See application file for complete search history.

(56) References Cited

U.S. PATENT DOCUMENTS 8,221,186 B2 * 7/2012 Policaro ..... A41C 3/08 2/119
8,523,629 B2 * 9/2013 Pundyk ..... A41C 3/0057 450/36
9,011,201 B2 * 4/2015 Chen ..... A41C 3/065 450/86
9,578,901 B2 * 2/2017 Randall ..... A41C 3/02
RE47,667 E * 10/2019 De Sousa ..... A41C 3/0057
2010/0105284 A1 * 4/2010 Policaro ..... A41C 3/08 450/86
2012/0244782 A1 * 9/2012 Pundyk ..... A41C 3/0057 450/70
2014/0162530 A1 * 6/2014 Wallace ..... A41C 3/08 450/32
2018/0000160 A1 * 1/2018 Taschner ..... A24F 40/46

* cited by examiner

*Primary Examiner* — Gloria M Hale

(57) ABSTRACT

The invention discloses a Convenient Adjustable Shaper Bra, comprising a cup body and a support lining fixed on its front surface. The support lining includes a bottom band and lifting straps extending upward from both ends. Two harnesses are arranged on the sides of the cup body, with shoulder straps connecting the harness and cup body. The shoulder straps have multiple connecting positions along their length, and the lifting straps have a detachable connecting structure. By adjusting the hook on the lifting strap to different positions, the cup body can be lifted as needed. Users can also install or remove a modesty panel between the cup body and support lining without taking off the bra, providing convenience and customization.

10 Claims, 13 Drawing Sheets

CONVENIENT ADJUSTABLE SHAPER BRA

TECHNICAL FIELD

The present invention relates to the technical field of bras, and in particular to an adjustable shaper bra.

BACKGROUND OF THE PRESENT INVENTION

Generally, women wear bras. In addition to providing basic protection for the breasts, modern bras are also designed to enhance aesthetic appearance. However, most women have inconsistent chest sizes and shapes. Therefore, various types of bras, such as sports bras, functional bras, underwire bras, and wireless bras, have been developed to meet different needs.

In the prior art, breast lifting and shaping are mainly achieved by incorporating underwires, soft lifting strips, palm-supported water-drop-shaped pads, or by widening the side portions of the bra to guide excess fat or auxiliary breast tissue toward the desired position. However, the lifting structures in these bras cannot be adaptively adjusted according to each user's breast shape. Users often need to adjust the lifting range to meet personal needs, yet existing solutions may be uncomfortable or incapable of providing a satisfactory lifting effect. As a result, users cannot achieve their ideal breast shape.

In addition, in existing technology, many women have different preferences regarding cleavage exposure depending on the occasion. Sometimes they want cleavage exposed; sometimes they prefer it covered. Many can only cover the area with their hands, which risks accidental exposure. For example, U.S. Pat. No. 8,152,591 B2 discloses a bra garment accessory in which a cloth sheet is added to cover the cleavage. However, this accessory must be looped around the outside of the bra and connected at the front cleavage position. As there are only three connection points between the accessory and the bra, the structure is not stable enough. Furthermore, such accessories do not match multiple underwear styles, and lateral shifting and wrinkling can seriously affect aesthetics. Assembly cannot be performed while the bra is worn; the accessory must be attached beforehand, which is inconvenient. During use, the accessory cannot be directly removed from the bra.

SUMMARY OF PRESENT INVENTION

In order to solve the above problems, the present invention proposes the adjustable shaper bra.

The technical solution adopted by the present invention is an adjustable shaper bra, including:

a cup body;

a support lining mounted on a front surface of the cup body and comprising at least a bottom band arranged to extend in a left-right direction, and a lifting strap respectively disposed at the left and right ends of the bottom band and extending upward, at least a portion of the support lining being resilient;

two harnesses respectively arranged on the left and right sides of the cup body, the ends of the harnesses being configured to fasten to each other on the back of the human body;

and two shoulder straps, each disposed between the corresponding harness and the cup body, the connecting end of each shoulder strap and the cup body being provided with a number of connection positions arranged at intervals along an extension direction of the shoulder strap, and the lifting strap being provided with a connection structure configured to engage and disengage the connection positions.

Several alternatives are also provided below. These alternatives are not additional limitations to the above-described overall scheme, but are merely further refinements or preferred implementations. Without technical or logical contradictions, the alternatives may be used individually with the above-described scheme or may be combined with one another.

Preferably, a middle portion of an upper end of the cup body is formed with a downward depression corresponding to the wearer's cleavage. The adjustable shaper bra further includes a modesty panel detachably arranged in front of the cup body to cover the depressed area.

Preferably, the modesty panel includes a main fabric lining, the left and right ends of which extend between the lifting strap and the cup body, and the lower end of which extends between the bottom band and the cup body.

Preferably, the lower end of the main fabric lining is provided with a bottom edge, and the left and right ends are provided with side edges. The bottom edge is arranged between the bottom band and the cup body, and the side edges are arranged between the lifting strap and the cup body.

Preferably, at least one first connecting buckle is provided on the front surface of the cup body, at least one second connecting buckle is provided on an inner side of the lifting strap, at least one third connecting buckle configured to mate with the first connecting buckle is provided on the side edge, and at least one fourth connecting buckle configured to mate with the second connecting buckle is also provided on the side edge. The third connecting buckle is arranged on an inner side of the side edge, and the fourth connecting buckle is arranged on an outer side of the side edge.

Preferably, the front surface of the cup body is provided with at least one first hook-and-loop fastener portion, which is positioned between the cup body and the lifting strap. The inner sides of the left and right ends of the main fabric lining are provided with second hook-and-loop fastener portions that correspond and engage with the first hook-and-loop fastener portion.

Preferably, each connection position includes a shackle provided on an upper surface of an end of the shoulder strap, and the connection structure includes a hook provided on an end of the lifting strap, the hook being selectively engageable with one of the shackles.

Preferably, multiple seam bindings are arranged along an extension direction of the shoulder strap, one end of each shackle being fixed within a seam binding such that the shackle is attached to the upper surface of the shoulder strap.

Preferably, the left and right sides of the upper end of the cup body form upper edges. One end of each shoulder strap is fixed to an upper edge. The cup body includes two bowl-shaped elastic breast supports whose upper surfaces are covered with a lace overlay. The left and right sides of the upper end of the lace overlay extend to the upper edges, and the lower end of the lace overlay extends to a coverage area of the support lining.

More preferably, the support lining is entirely resilient, the shoulder straps and harnesses are resilient, and the main fabric lining is made of lace fabric.

Compared with the prior art, the present invention offers the following beneficial effects:

The front surface of the cup body is provided with an elastic support lining. The left and right ends of the support lining are provided with lifting straps that cooperate to provide lifting. Multiple shackles are arranged at the connection between each shoulder strap and the cup body. Since the bottom band of the support lining is fixed to the cup body, and the lower part of the lifting strap is also fixed to the cup body, the lifting amplitude can be adjusted by hanging the hook at the upper end of the lifting strap on different shackles. When the hook is hung on a higher shackle, the lifting amplitude is greater; when hung on a lower shackle, the lifting amplitude is smaller. This allows a user to freely adjust the lifting and shaping effect of the bra to suit personal needs.

Since both shoulder straps are individually provided with multiple shackles, users with asymmetrical breast sizes can independently adjust the lifting effect on each side, resulting in a more balanced and aesthetically pleasing appearance.

By providing a modesty panel between the cup body and the support lining, and attaching the modesty panel using snap fasteners or hook-and-loop fasteners, the user can install or remove the modesty panel based on preferences regarding cleavage exposure. The bra does not need to be removed during installation or removal of the modesty panel, making the design convenient to use.

BRIEF DESCRIPTION OF THE DRAWINGS

For a clearer description of the technical features of the embodiments of the utility model or the prior art, a brief description of the drawings used to illustrate the embodiments or the prior art is provided below. It is apparent that the embodiments described are only part of the embodiments of the utility model. For those skilled in the art, other drawings can be derived based on these structures without creative effort.

Figure 1:
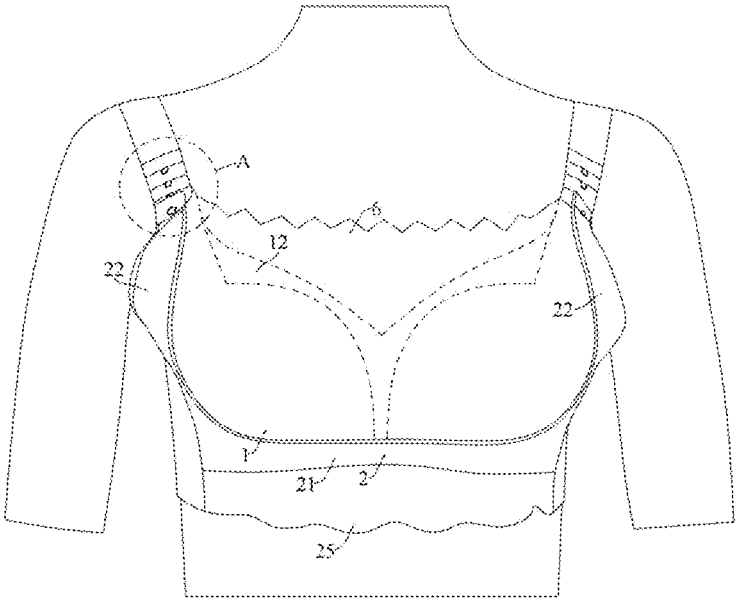
FIG. 1 is a schematic front-view structural diagram of an adjustable shaper bra with a modesty panel worn on a human body in an embodiment of the present application.

The drawings include reference numerals identifying the components of the adjustable shaper bra for ease of understanding. These components include: cup body 1; upper edge 11; lace overlay 12; first connecting buckle 121; first hook-and-loop fastener portion 122; side boning 13; connecting fabric 14; underwire 15 (optional); bottom boning 16; side support 17; support lining 2; bottom band 21; lifting straps 22; end piece 23; hook 24; lower lace trim 25; second connecting buckle 26; shoulder strap 3; shackle 31; seam binding 32; first harness 4; first connecting part 41; hook-and-eye closure 411; second harness 5; second connecting part 51; hook-and-eye fastener elements 511; modesty panel 6; main lining 61; side edge 62; bottom edge 63; third connecting buckle 64; fourth connecting buckle 65; and second hook-and-loop fastener portion 66. The embodiments described below refer to these numerals in conjunction with the accompanying drawings to illustrate the structure and operation of the adjustable shaper bra.

DETAILED DESCRIPTION OF THE EMBODIMENTS

With reference to the drawings in the embodiments of the present invention, the following provides a clear and complete description of the technical solutions contained in the embodiments. It should be understood that the described embodiments are merely some, rather than all, of the embodiments of the present invention. All other embodiments obtained by persons of ordinary skill in the art based on the embodiments of the present invention, without creative effort, shall fall within the scope of protection of the present invention.

It should be noted that all directional indications (such as up, down, left, right, front, back, etc.) in the embodiments of the present invention are used only to describe the relative positional relationships, motion states, and orientations of the various components under a specific posture (as shown in the drawings). If the posture changes, the directional indications should be adjusted accordingly.

In addition, references to terms such as "first," "second," and the like in the present invention are for descriptive purposes only and should not be construed as indicating or implying relative importance, or as implying any particular order or quantity of the features described. Features designated as "first" or "second" may include one or more of the corresponding elements. The technical features described in various embodiments may be combined with one another, provided that such combinations can be reasonably implemented by a person of ordinary skill in the art. When a combination of technical features leads to contradiction or cannot be implemented, such a combination shall be deemed nonexistent and outside the scope of the present invention.

Referring to FIGS. 1-13, the present invention is an adjustable shaper bra, comprising:

cup body 1;

support lining cloth 2 mounted on the front surface of cup body 1 and including at least a bottom band 21 arranged in a left-right direction and a lifting strap 22 respectively arranged at the left-right ends of the bottom band 21 and extending upward, at least part of the support lining 2 being resilient;

harness, two of which are respectively arranged on the left and right sides of cup body 1, and the ends of the two straps being suitable for fastening to each other on the back of the human body;

and shoulder strap 3, provided with two straps between the harness and cup body 1, the connecting end of the shoulder strap 3 and cup body 1 being provided with a number of connecting positions arranged at intervals along the extension direction of the shoulder strap 3, and the lifting strap 22 being provided with a connecting structure for detachable connection of the mating and connecting positions.

Figure 5:
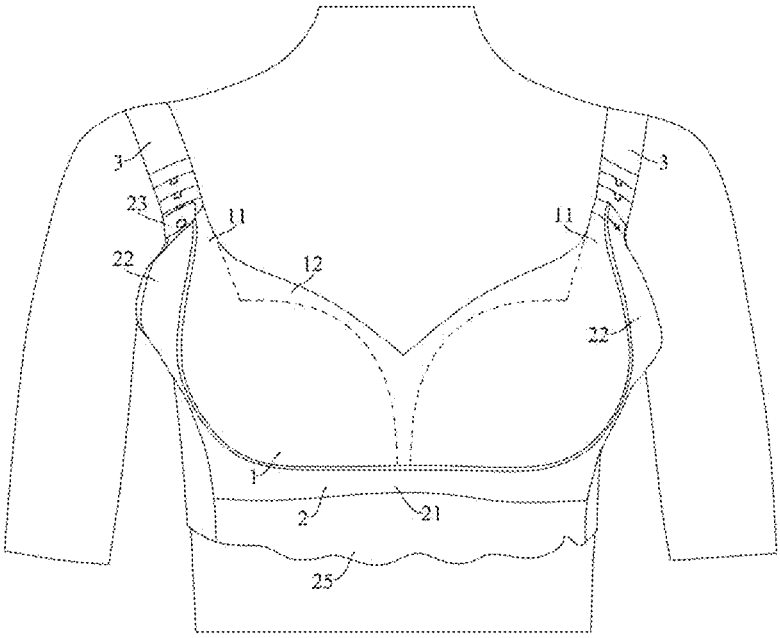
FIG. 5 is a schematic diagram showing the adjustable shaper bra worn on a human body with the modesty panel removed, according to an embodiment of the present application.

As a preferred implementation of this embodiment, please refer to FIG. 5. It can be seen that the middle position of the upper end of cup body 1 is provided with a downward depression, corresponding to the depressed area of the human cleavage.

Then, referring to FIG. 1, it can be seen that in this embodiment, the adjustable shaper bra also includes a modesty panel 6, which is detachably arranged in front of cup body 1 and covers the depressed area.

In this embodiment, modesty panel 6 includes a main fabric lining 61, with the left and right ends of the main fabric lining 61 extending between the lifting strap 22 and cup body 1, respectively, and the lower end of the main fabric lining 61 extending between the bottom band 21 and cup body 1.

Here, by hiding the lower end and the left and right ends of the main fabric lining 61 between cup body 1 and support lining 2, on the one hand, the structure is more aesthetically pleasing, and the fitting assembly structures on main fabric lining 61 can be set at these hidden positions (the lower end or the left and right ends of main fabric lining 61). On the other hand, the exposed front portion of cup body 1 can also be covered by main fabric lining 61, so that the texture and overall appearance when worn are improved.

Two exemplary methods for attaching the modesty panel 6 to the cup body 1 are described herein: a snap-fastener connection and a hook-and-loop fastener connection. These examples are provided for illustration only, and other suitable attachment structures may also be used without departing from the spirit of the invention.

Figure 3:
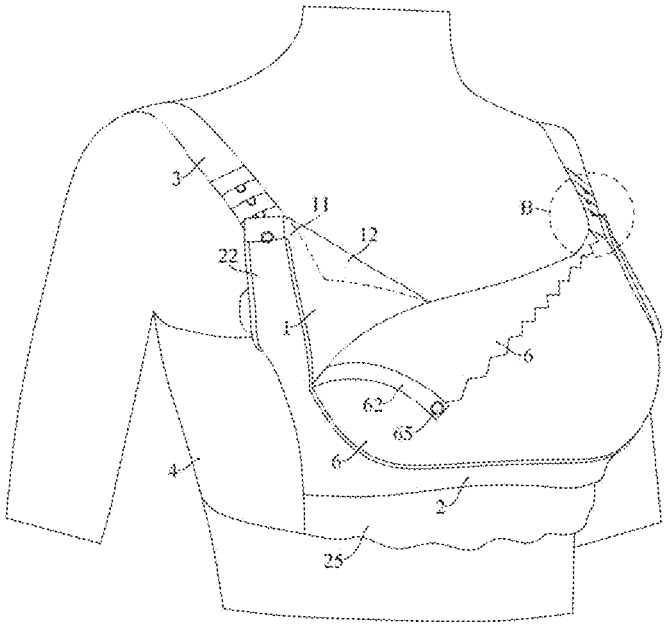
FIG. 3 is a schematic diagram showing the adjustable shaper bra worn on a human body with one corner of the modesty panel opened outward in an embodiment of the present application.
Figure 4:
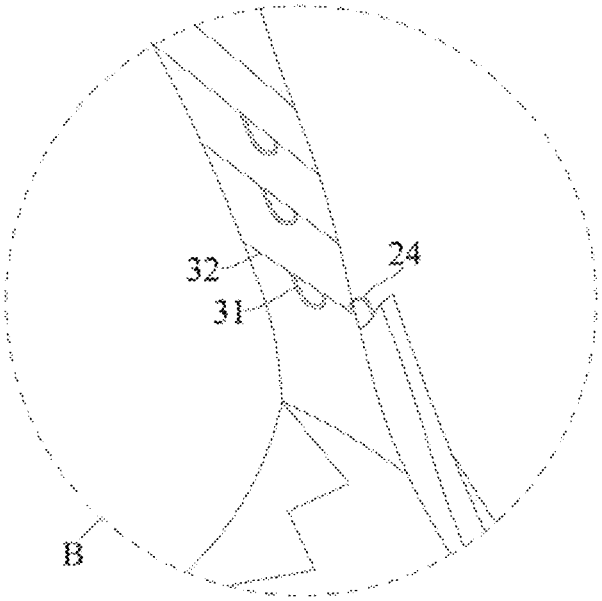
FIG. 4 is a partial enlarged view of Part B in FIG. 3.
Figure 7:
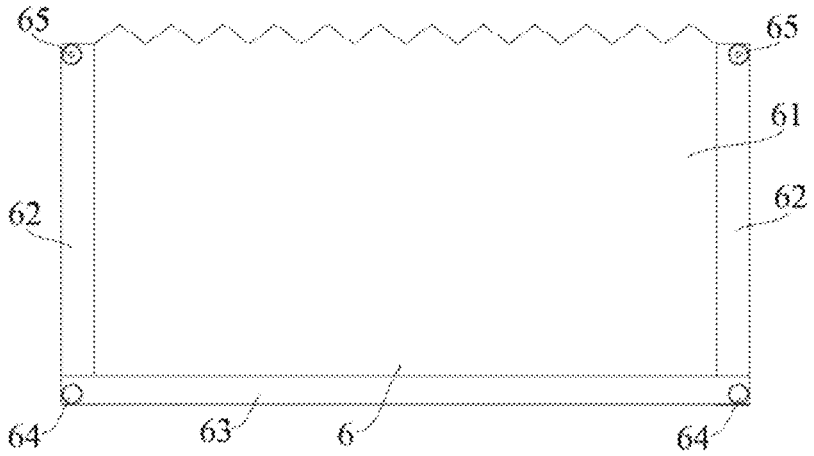
FIG. 7 is a schematic plan view of a modesty panel equipped with snap-fastener buckles in an embodiment of the present application.
Figure 12:
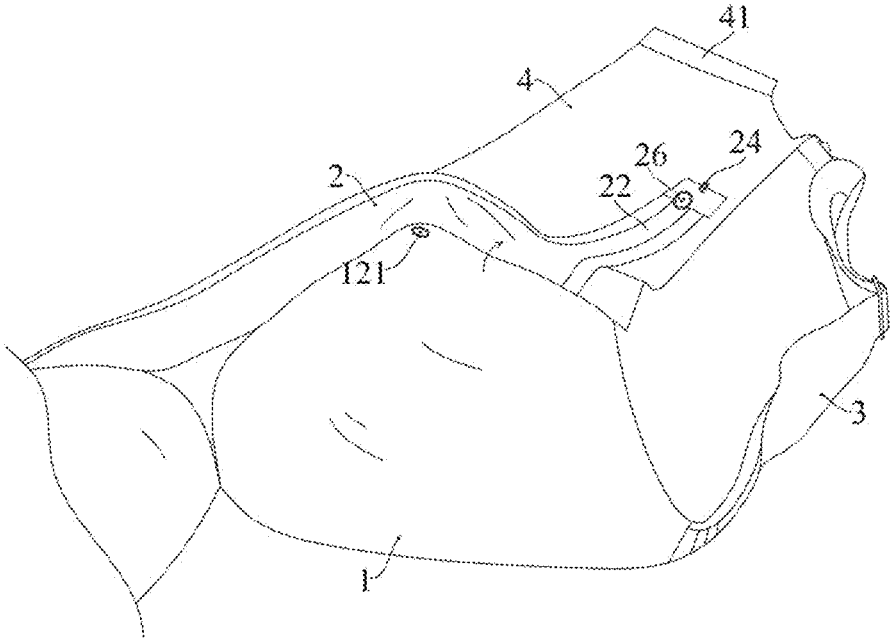
FIG. 12 is a schematic structural diagram of the adjustable shaper bra using a snap-fastener structure after part of the support lining is opened, according to an embodiment of the present application.

When the connection between the modesty panel 6 and cup body 1 is completed with a snap-fastener structure:

Referring to FIGS. 3, 7, and 12, it can be seen that in this embodiment, the lower end of main fabric lining 61 is provided with a bottom edge 63, and the left and right ends of main fabric lining 61 are respectively provided with side edges 62. Bottom edge 63 is arranged between bottom band 21 and cup body 1, and side edge 62 is arranged between lifting strap 22 and cup body 1.

Then, in this embodiment, a first connecting buckle 121 is provided on the front surface of cup body 1, the first connecting buckle 121 corresponding to the lower position of lifting strap 22, and a second connecting buckle 26 is provided on the upper inner side of lifting strap 22. Side edge 62 is provided with a third connecting buckle 64 for fastening to mate with first connecting buckle 121, and a fourth connecting buckle 65 for fastening to mate with second connecting buckle 26. The third connecting buckle 64 is arranged on the inside of side edge 62, and the fourth connecting buckle 65 is arranged on the outside of side edge 62.

When it is necessary to install modesty panel 6 on cup body 1, two side edges 62 of main fabric lining 61 are first placed between lifting strap 22 and cup body 1, and the bottom edge 63 of main fabric lining 61 is placed between bottom band 21 and cup body 1. Then, first connecting buckle 121 and third connecting buckle 64 are fastened together, and second connecting buckle 26 and fourth connecting buckle 65 are fastened together, completing the assembly between modesty panel 6 and cup body 1.

When it is necessary to remove modesty panel 6, the fastening between first connecting buckle 121 and third connecting buckle 64 and the fastening between second connecting buckle 26 and fourth connecting buckle 65 can be manually released.

Figure 8:
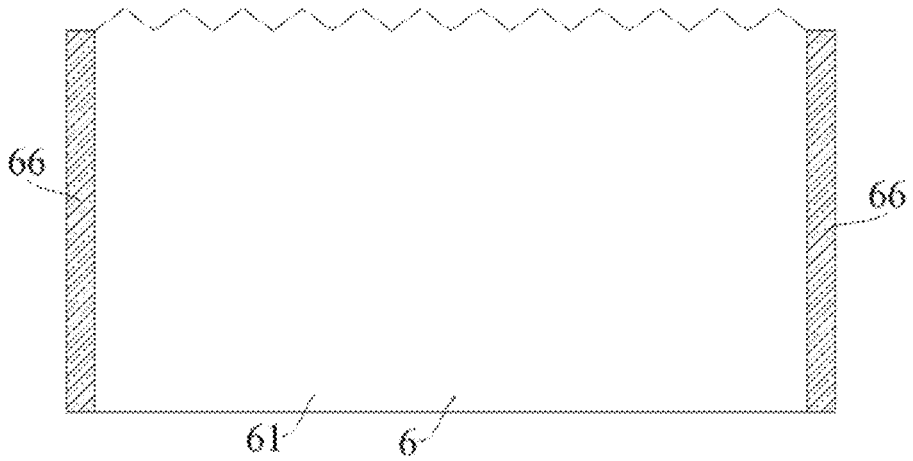
FIG. 8 is a plan schematic view of a modesty panel equipped with a hook-and-loop fastener structure in an embodiment of the present application.
Figure 9:
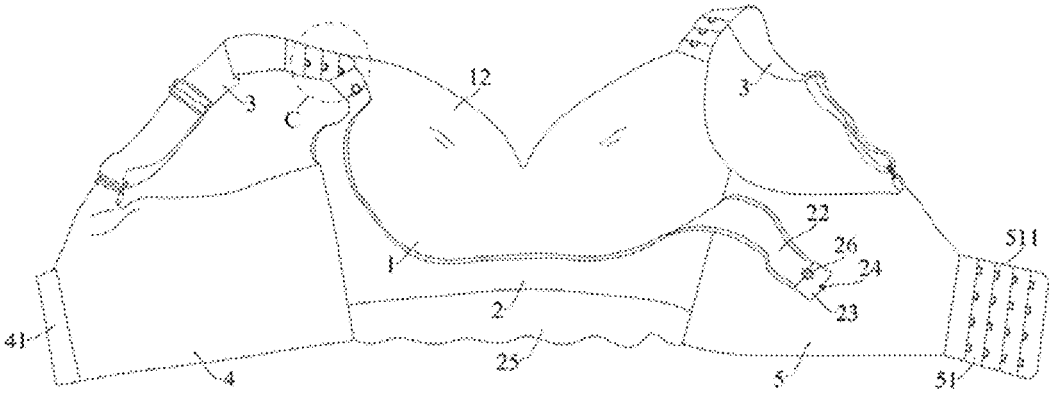
FIG. 9 is a schematic front-view structural diagram of the adjustable shaper bra in an open state according to an embodiment of the present application.
Figure 10:
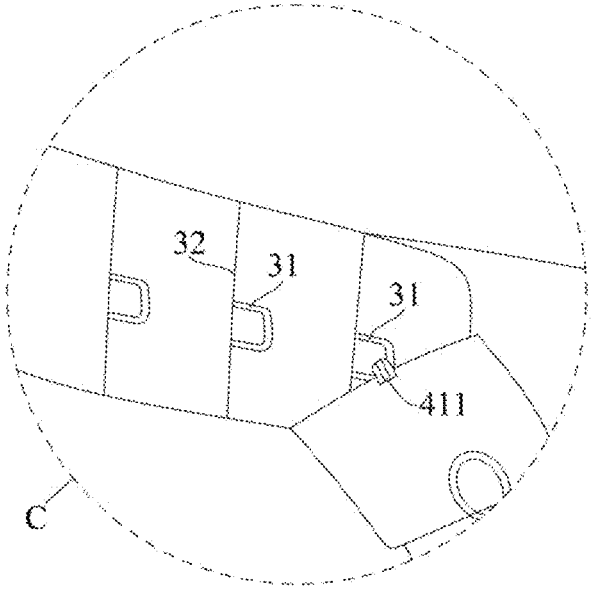
FIG. 10 is a partial enlarged view of Part C in FIG. 9.
Figure 11:
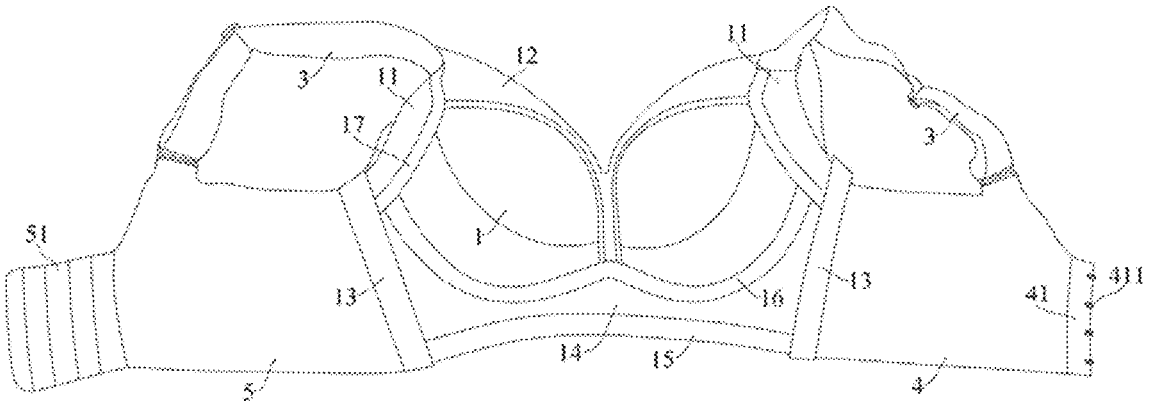
FIG. 11 is a schematic rear-view structural diagram of the adjustable shaper bra in an open state in an embodiment of the present application.
Figure 13:
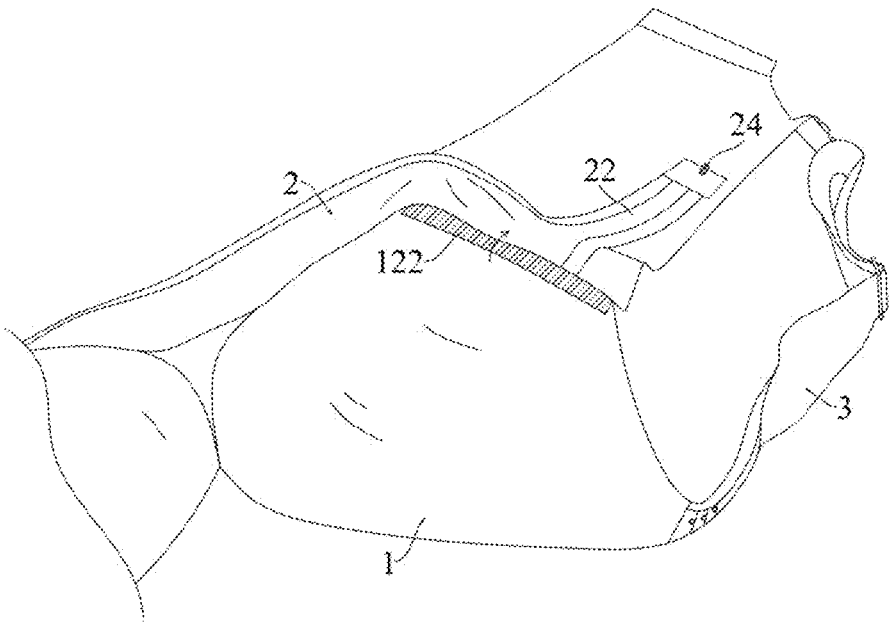
FIG. 13 is a schematic structural diagram of the adjustable shaper bra using a hook-and-loop fastener structure after part of the support lining is opened, according to an embodiment of the present application.

When the connection between the modesty panel 6 and cup body 1 is completed with a hook-and-loop fastener structure:

Referring to FIGS. 8 and 13, it can be seen that in this embodiment, the front surface of cup body 1 is provided with a first hook-and-loop fastener portion 122, the first hook-and-loop fastener portion 122 being positioned between cup body 1 and lifting strap 22. The inner sides of the left and right ends of main fabric lining 61 are provided with a second hook-and-loop fastener portion 66, and the first hook-and-loop fastener portion 122 and the second hook-and-loop fastener portion 66 are correspondingly fitted.

When it is necessary to install modesty panel 6 on cup body 1, two side edges 62 of main fabric lining 61 are first placed between lifting strap 22 and cup body 1, and bottom edge 63 of main fabric lining 61 is placed between bottom band 21 and cup body 1. During placement of the main fabric lining 61, the first hook-and-loop fastener portion 122 on cup body 1 and the second hook-and-loop fastener portion 66 on main fabric lining 61 should be aligned. After alignment, the assembly between modesty panel 6 and cup body 1 can be completed by gently pressing the two side edges 62 of main fabric lining 61.

When it is necessary to remove modesty panel 6, the bond between the first hook-and-loop fastener portion 122 and the second hook-and-loop fastener portion 66 can be manually separated.

Referring to FIGS. 1-5, 9, and 10, in this embodiment the connection between the lifting strap 22 and the shoulder strap 3 is achieved through a series of shackles 31 arranged on the upper surface of the shoulder strap 3. The lifting strap 22 carries a hook 24 at its upper end, and the hook 24 can be selectively engaged with any one of the shackles 31 to form the adjustable connection.

A number of seam bindings 32 are provided along the length of the shoulder strap 3 in the strap's extension direction. Each shackle 31 is positioned within one of the seam bindings 32, and the seam binding 32 secures the shackle 31 to the upper surface of the shoulder strap 3. In this embodiment, portions of the seam binding 32 overlap. One end of each shackle 31 is inserted into the overlapping region and then fixed by stitching, ensuring that the shackle 31 is firmly and reliably attached to the shoulder strap 3.

Figure 2:
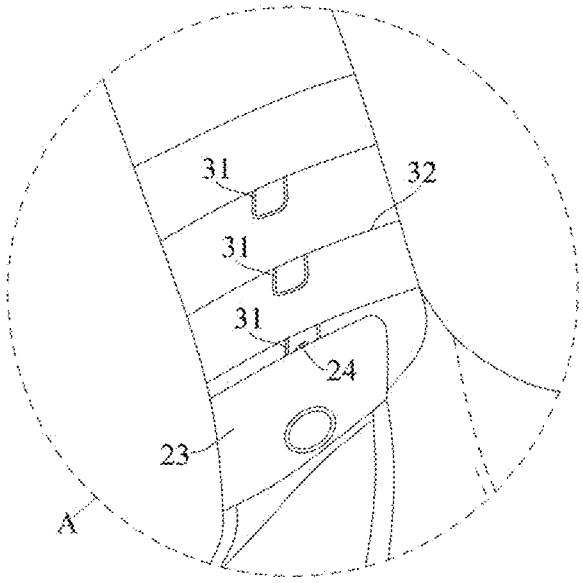
FIG. 2 is a partial enlarged view of Part A in FIG. 1.

As shown in FIGS. 1 and 2, the upper end of each lifting strap 22 is provided with an end piece 23. The hook 24 extends into the interior of the end piece 23 and is secured in place by stitching.

Because the hook 24 engages the shackle 31 and the support lining 2 continuously applies a lifting force during wear, a significant interaction force exists between the hook 24 and shackle 31. Therefore, the attachment strength between each shackle 31 and the shoulder strap 3, as well as the attachment strength between each hook 24 and its corresponding lifting strap 22, must be sufficient to prevent detachment during normal use.

In this embodiment, the bottom band 21 of the support lining 2 is fixed to the cup body 1, and the lower portion of each lifting strap 22 is likewise fixed to the cup body 1. As a result, when the hook 24 at the upper end of the lifting strap 22 is engaged with different shackle positions 31, the lifting amplitude of the support lining 2 can be adjusted. Engagement with a higher shackle increases the lifting effect, while engagement with a lower shackle decreases it, allowing the wearer to customize the shaping and lifting effect according to personal needs.

As shown in FIGS. 2 and 12, the bottom band 21 is sewn to the cup body 1, the lower portion of each lifting strap 22 is also sewn to the cup body 1, and the upper portion of each lifting strap 22 remains unattached. This unfixed upper portion allows the wearer to grasp the lifting strap 22 by hand, making it easier to reposition the hook 24 on a selected shackle 31 during adjustment.

Next, referring to FIGS. 3, 5, 9, and 11, it can be seen that in this embodiment, the upper end of cup body 1 includes left and right upper edges 11. One end of shoulder strap 3 is fixed to the upper edge 11. Cup body 1 includes two bowl-shaped elastic breast supports, and the upper surfaces of the two elastic breast supports are fixed with lace overlay 12. The left and right sides of the upper end of lace overlay 12 extend to the upper edges 11, and the lower end of lace overlay 12 extends to the coverage area of support lining 2.

In addition, in order to secure the position of the elastic breast supports and enhance the overall structural strength of the bra, side support 17 is disposed on the side of each elastic breast support, and bottom boning 16 is arranged on the lower side of the elastic breast support.

Moreover, in this embodiment, connecting fabric 14 is fixedly arranged under the elastic breast supports. The lower end of connecting fabric 14 may optionally be provided with an underwire 15 as needed. The presence of underwire 15 can strengthen the overall structural rigidity of the bra and reduce deformation during use.

Figure 6:
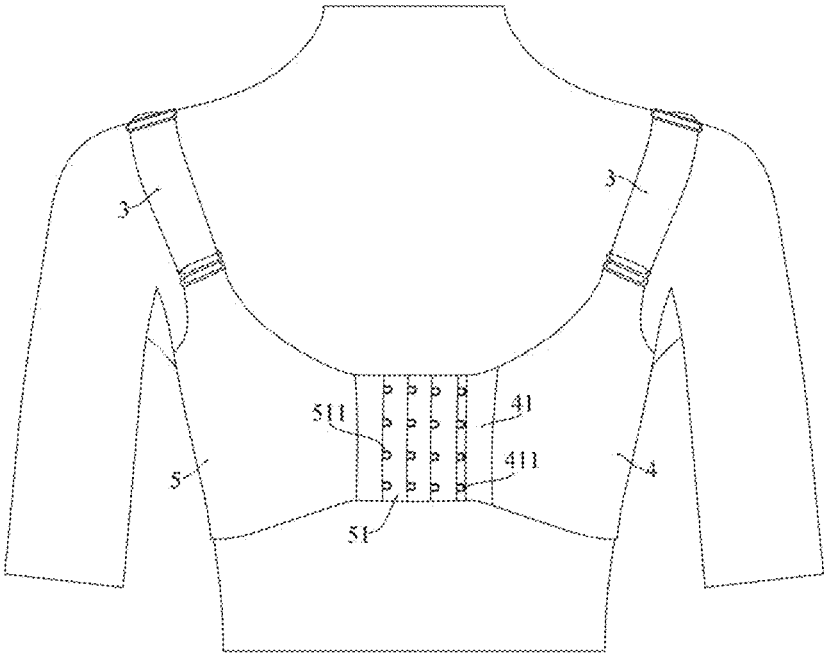
FIG. 6 is a schematic rear-view structural diagram of the adjustable shaper bra worn on a human body in an embodiment of the present application.

Referring to FIGS. 3 and 6, it can be seen that in this embodiment, the two harnesses are first harness 4 and second harness 5, respectively. One end of first harness 4 is fixed on the left side of connecting fabric 14, and one end of second harness 5 is fixed on the right side of connecting fabric 14. In order to increase the structural strength of the connection between the harnesses and connecting fabric 14, side boning 13 is provided at the connection.

In this embodiment, the free end of first harness 4 is provided with a first connection part 41, and the free end of second harness 5 is provided with a second connection part 51. Second connection part 51 is provided with a hook-and-eye closure 411, and second connection part 51 is further provided with a number of row-spaced hook-and-eye fastener elements 511. The fastening between first connection part 41 and second connection part 51 is accomplished by attaching hook-and-eye closure 411 to one of the hook-and-eye fastener elements 511. The tightness of the harness can be freely adjusted by selecting the appropriate position of hook-and-eye closure 411 relative to hook-and-eye fastener elements 511. The connection structure of first harness 4 and second harness 5 belongs to the prior art, and therefore is only briefly described here.

More specifically, in this embodiment, the whole support lining 2 is elastic, the shoulder strap 3 and the harnesses are elastic, and the main fabric lining 61 is a lace cloth. In addition, the lower end of bottom band 21 is fixedly provided with a lower lace trim 25.

The above description of the present invention, the adjustable shaper bra, is only a preferred embodiment of the present invention and does not limit the scope of the patent of the present invention. Any equivalent structural change made by using the description and drawings of the present invention, or directly or indirectly applied in other related technical fields under the concept of the present invention, is included within the scope of protection of the present invention.

What is claimed is:

1. An adjustable shaper bra comprising:

a cup body;

a support lining fixed to a front surface of the cup body and including at least a bottom band arranged in a left-right direction and a lifting strap arranged at left and right ends of the bottom band and extending upward, at least a portion of the support lining being resilient;

two harnesses respectively arranged on left and right sides of the cup body, ends of the harnesses being configured to fasten to each other on a back side of a wearer; and two shoulder straps respectively disposed between the harnesses and the cup body, each shoulder strap having a connecting end connected to the cup body, the connecting end being provided with a plurality of connection positions arranged at intervals along an extension direction of the shoulder strap, and the lifting strap being provided with a connection structure configured to selectively engage and disengage the connection positions.

2. The adjustable shaper bra of claim 1, wherein a middle portion of an upper end of the cup body is formed with a downward depression corresponding to a wearer's cleavage region, and further comprising a modesty panel detachably arranged in front of the cup body to cover the depressed area.

3. The adjustable shaper bra of claim 2, wherein the modesty panel comprises a lining-cloth main body, left and right ends of the lining-cloth main body respectively extending between the lifting strap and the cup body, and a lower end of the lining-cloth main body extending between the bottom band and the cup body.

4. The adjustable shaper bra of claim 3, wherein the lower end of the lining-cloth main body is provided with a bottom edge, and left and right ends of the lining-cloth main body are respectively provided with side edges, the bottom edge being arranged between the bottom band and the cup body, and the side edges being arranged between the lifting strap and the cup body.

5. The adjustable shaper bra of claim 4, wherein at least one first connecting buckle is provided on an inner side of the lifting strap, at least one second connecting buckle is provided on the side edge, at least one third connecting buckle configured to mate with the first connecting buckle is provided on an inner side of the side edge, and at least one fourth connecting buckle configured to mate with the second connecting buckle is provided on an outer side of the side edge.

6. The adjustable shaper bra of claim 3, wherein a front surface of the cup body is provided with at least one first hook-and-loop fastener portion located between the cup body and the lifting strap, and inner sides of the left and right ends of the lining-cloth main body are provided with second hook-and-loop fastener portions that correspondingly engage the first hook-and-loop fastener portions.

7. The adjustable shaper bra of claim 1, wherein each connection position comprises a shackle provided on an upper surface of an end of the shoulder strap, the connection structure comprises a hook provided on an end of the lifting strap, and the hook is selectively engageable with one of the shackles.

8. The adjustable shaper bra of claim 7, wherein a plurality of seam bindings are arranged on the shoulder strap along an extension direction of the shoulder strap, one end of each shackle being fixed in a corresponding seam binding and the shackle being attached to the upper surface of the shoulder strap.

9. The adjustable shaper bra of claim 1, wherein the upper ends of the cup body define left and right upper edges, one end of each shoulder strap being fixed to a corresponding upper edge, the cup body comprising two bowl-shaped elastic breast supports, upper surfaces of the elastic breast supports being fixed with a lace overlay, left and right sides of an upper end of the lace overlay respectively extending to the upper edges, and a lower end of the lace overlay extending to a coverage area of the support lining.

10. The adjustable shaper bra of claim 3, wherein the support lining is entirely resilient, the shoulder straps and the harnesses are resilient, and the lining-cloth main body is formed of lace fabric.

* * * * *